United States Patent [19]

Rich et al.

[11] 4,188,748

[45] Feb. 19, 1980

[54] TOY VEHICLE AND HOUSING SET

[75] Inventors: Hubert A. Rich, Westminster; Herbert May, Torrance, both of Calif.

[73] Assignee: Mattel, Inc., Hawthorne, Calif.

[21] Appl. No.: 946,997

[22] Filed: Sep. 29, 1978

[51] Int. Cl.[2] ..... A63H 11/10

[52] U.S. Cl. ..... 46/202; 46/223; 46/206

[58] Field of Search ..... 46/202, 223, 221, 206, 46/17, 201, 204, 216

[56] References Cited

U.S. PATENT DOCUMENTS

| | | | |
|---|---|---|---|
| 1,890,624 | 12/1932 | Shadish | 46/223 |
| 2,791,867 | 5/1957 | Dasher | 46/17 |
| 3,545,757 | 12/1970 | Tepper et al. | 46/202 X |
| 4,109,412 | 8/1978 | Saito | 46/223 X |

*Primary Examiner*—Louis G. Mancene
*Assistant Examiner*—Mickey Yu
*Attorney, Agent, or Firm*—John G. Mesaros; Max E. Shirk

[57] ABSTRACT

A toy vehicle and housing set, the toy vehicle having a body with a shell member positionable thereover, the shell member being configured for simulating a body of another type vehicle. The housing has a track section for traversal of the vehicle thereover and sidewalls generally perpendicular to the track section, the shell member and housing sidewalls having coacting portions for removing the shell member from the vehicle during traversal of the vehicle therethrough. The housing contains a booster for accelerating the vehicle from the exit end thereof.

14 Claims, 5 Drawing Figures

TOY VEHICLE AND HOUSING SET

BACKGROUND OF THE INVENTION

The background of the invention will be discussed in two parts:

Field of the Invention

This invention relates to toy vehicles and more particularly to a toy vehicle and accessory set.

Description of the Prior Art

Toy vehicles of the die-cast free rolling variety have become increasingly popular, such toy vehicles generally being utilized on a track comprised of a plurality of sections interconnected to define a pathway for travel thereover. The track can be formed by connecting the sections into a single strip, one end of which may be connected to a higher elevation to provide gravity operation, or alternatively the track may be configured in a closed loop. With such closed loop tracks, other toy vehicles of the die-cast or plastic type utilizing battery operated motors may also be employed. In some such vehicles, the batteries are the nickel-cadmium type which are rechargeable by means of an electrical connector.

With the advent of such vehicles, accessories and sets have been developed to provide greater amusement. One such accessory is commonly referred to as a "booster" which may be manually operated by means of a lever, or may be spring loaded and operable by depression of a button. In either event, the booster propels the vehicle along the trackway, and with a closed loop trackway oftentimes the particular booster may be reset and re-operated as the vehicle traverses the booster section. Such booster mechanisms are generally only employed when a toy vehicle of the free-wheeling type is utilized.

It is an object of the present invention to provide a new and improved toy vehicle and accessory combination.

It is another object of the present invention to provide a toy vehicle and housing combination.

It is still another object of the present invention to provide a toy vehicle having an auxiliary body for creating an illusion when the vehicle passes through the housing.

SUMMARY OF THE INVENTION

The foregoing and other objects of the invention are accomplished by providing a toy vehicle and housing combination, the toy vehicle having a body of a first configuration. A shell member is provided for simulating a body style of a much larger vehicle, for example, a van. The shell member is provided with inwardly extending projections on the interior surface thereof for positioning on the toy vehicle body to thereby give the appearance of the larger vehicle. The shell member is provided with outwardly extending protuberances which may be in the form of simulated side mirrors, bumpers, running boards, air foil, antennas, etc. A housing is provided with a track section adjacent the bottom thereof for traversal of the toy vehicle thereover, and upwardly extending sidewalls having opposing ramp surfaces configured for coacting with the outwardly extending protuberances to thereby elevate the shell member from the position on the toy vehicle to an elevation sufficiently high for passage thereunder of a toy vehicle. A spring loaded resettable booster mechanism is provided below the trackway within the housing, the booster mechanism having a rocker arm pivotable generally about its midpoint, the rocker arm being configured for passage through a slot in the trackway so that, when set, one end of the rocket arm abuts against the edge of the slot with a portion thereof extending above the trackway. Upon contact with the toy vehicle, the one arm is depressed thereby pivoting the other arm upwardly through the slot, the other arm having a vehicle engaging projection for propelling the vehicle through the exit end of the housing. The illusion thus created is that of a slower moving large vehicle entering the housing and a rapidly accelerating sportster or racing type vehicle leaving the housing. A removable or hinged cover is provided on the housing for removing the shell member for subsequent placement on the vehicle.

Other objects, features, and advantages of the invention will become apparent from a reading of the specification when taken in conjunction with the drawings in which like reference numerals refer to like elements in the several views.

DESCRIPTION OF THE PREFERRED EMBODIMENT

Figure 1:
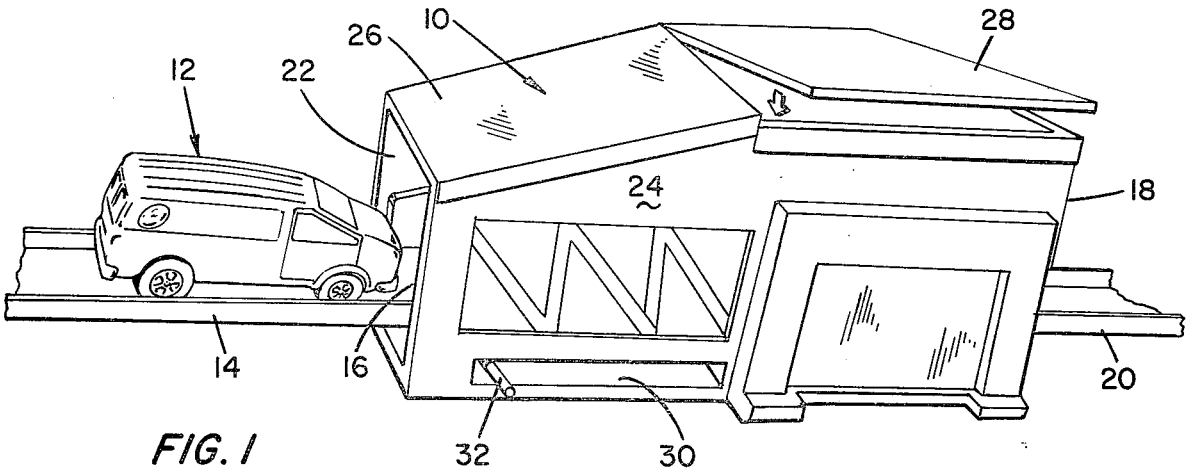
FIG. 1 is a perspective view of the toy vehicle and housing set according to the invention.

Referring now to the drawings and particularly to FIG. 1 there is shown a toy vehicle and housing combination including a housing generally designated 10 and a toy vehicle combination generally designated 12 traversing a track section 14 for entering the housing 10 through the entrance end 16 thereof for passage therethrough through the exit end 18 to another track section 20. The housing 10 includes a track section therein for traversal thereover of the toy vehicle combination 12. The housing 10 includes opposite generally parallel sidewalls 22 and 24 on either side of the trackway with a suitable cover in the form of a roof, the cover being in two parts 26 and 28, either or both of which may be removable or hinged to provide access to the interior of housing 10. In the one sidewall 24, an elongate slot 30 is formed, the slot 30 being generally parallel to the direction of travel of the toy vehicle combination 12. Protruding outwardly from slot 30 is a reset lever 32 for operation of the booster mechanism as will hereinafter be discussed.

Figure 2:
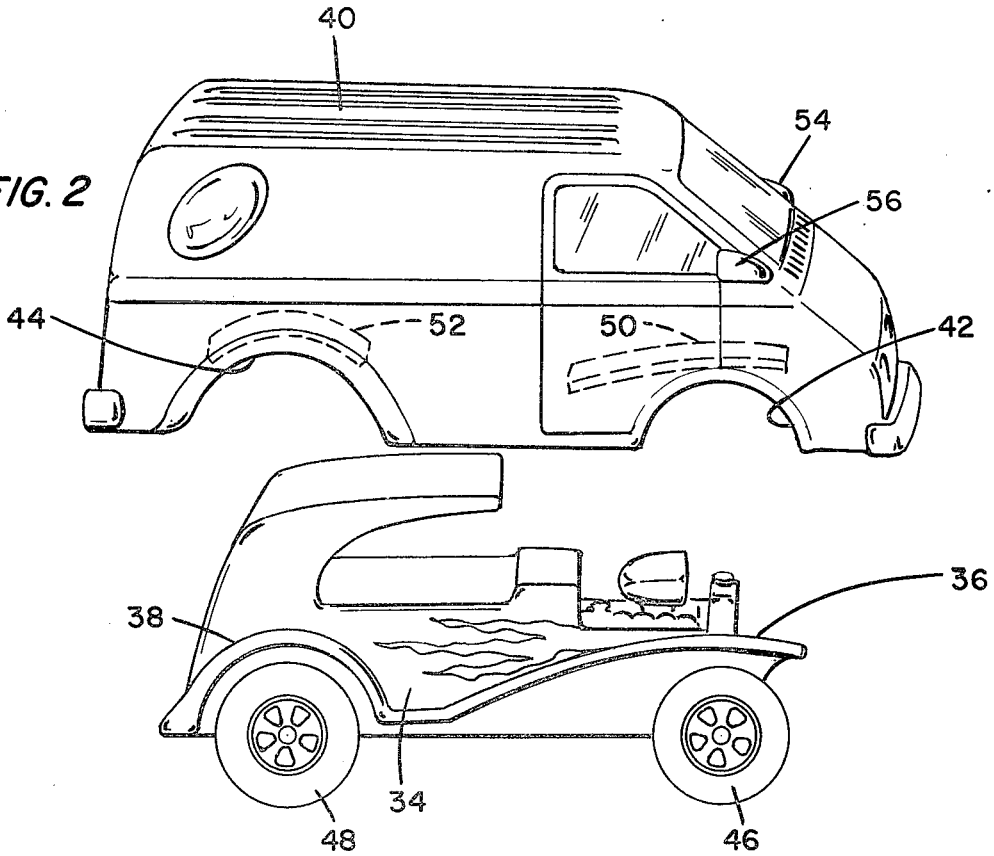
FIG. 2 is an exploded perspective view of the toy vehicle and shell member used in the toy of FIG. 1.

Referring now to FIG. 2, the toy vehicle combination 12 includes a toy vehicle 34 which, as illustrated, is in the form of a modified roadster or sportster, the vehicle 34 having front sweeping fenders 36 and rear fenders 38. The toy vehicle 34 may be of the die-cast free-wheeling type, or it may be of the motor operated type. However, if the toy vehicle 34 is motor operated, the booster mechanism of the instant invention will not be required, although it could be utilized.

Disposed above the vehicle 34 is a shell member 40 which has a generally hollow interior and configured in the form of the body of a van or a much larger vehicle than the toy vehicle 34. The shell member 40 is provided with cutouts 42 and 44 to simulate the wheel wells of a conventional van with the spacing between the cutouts 42 and 44 being dimensioned to position the wheels 46 and 48 of the vehicle 34 generally centrally relative thereto in conventional fashion when the shell member 40 is positioned on the vehicle 34. Formed integrally on the interior of shell member 40 are inwardly extending contoured projections or strips 50 and 52, the strips 50 and 52 taking any convenient configuration. In the present embodiment, the strips 50 and 52 are generally contoured to coact with and generally abut the outwardly flaring fenders 36 and 38 respectively of the toy vehicle 34 for resting thereon. With the shell member 40 resting on the vehicle 34, the vehicle 34 thus assumes the appearance of the shell member 40.

Projecting outwardly from opposite sides of the shell member 40 are a pair of aligned protuberances 54 and 56 which may be in the form of simulated spotlights, simulated side mounted mirrors, air foils, running boards, bumpers, antennas, etc. In any event, the protuberances 54 and 56 generally extend out beyond the slab-sides of the van or shell member 40 for projecting beyond the maximum width thereof.

Figure 3:
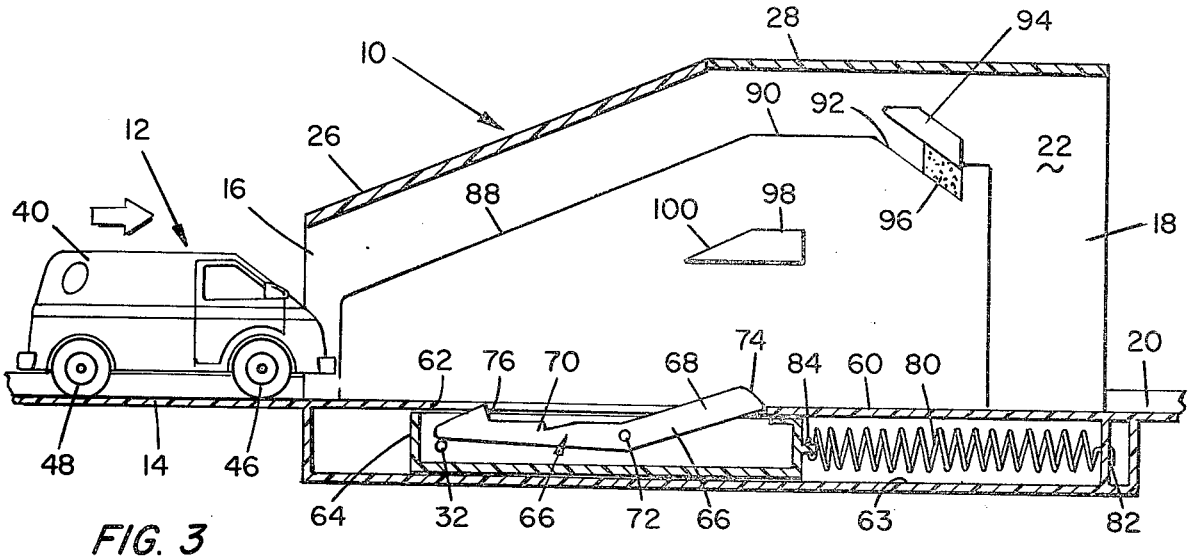
FIGS. 3–5 are side elevational views partially in cross-section, sequentially illustrating the passage of the toy vehicle through the housing for removing the shell member from the toy vehicle and for propelling the toy vehicle.
Figure 4:
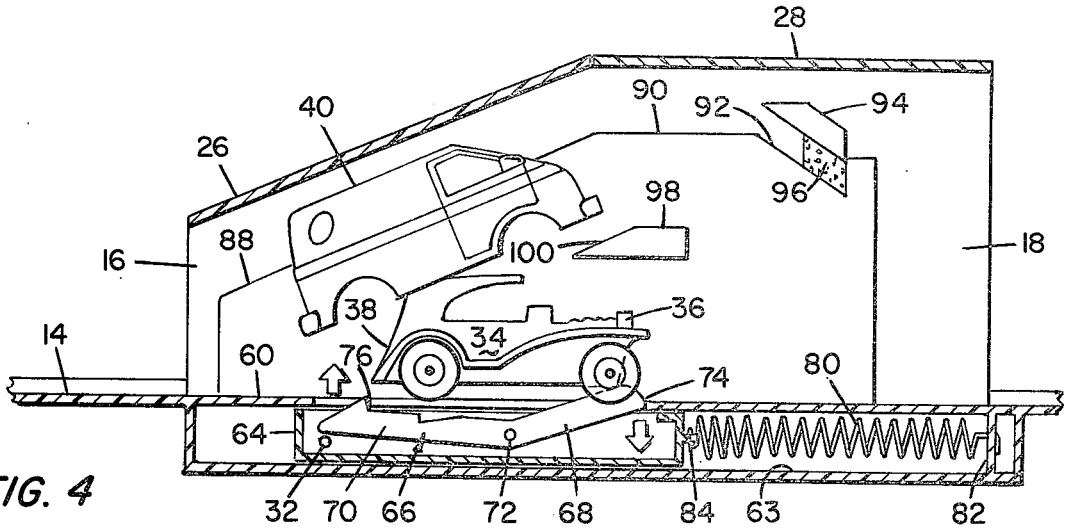
Figure 5:
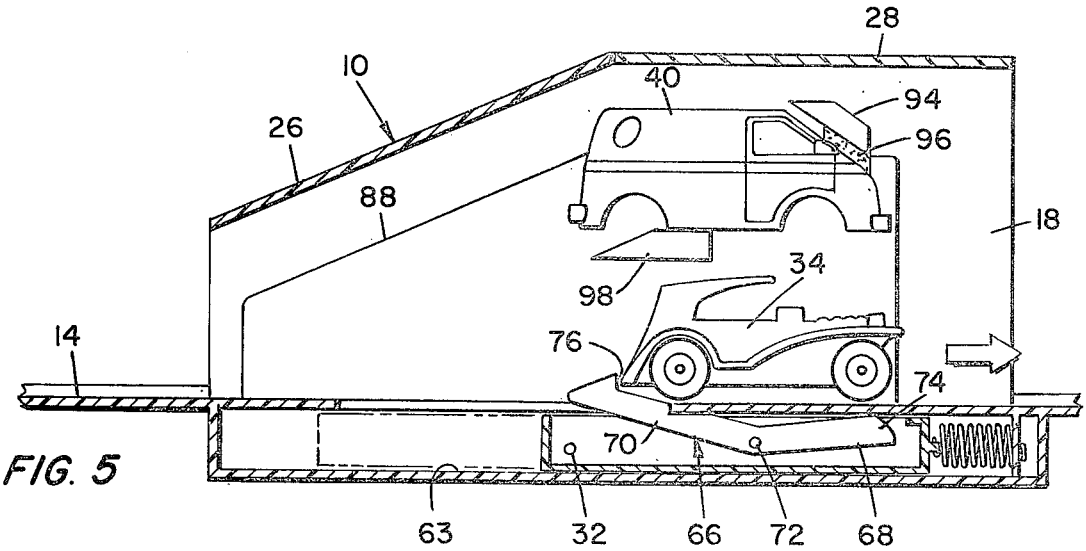

Referring now to FIGS. 3–5, the housing 10 has a track portion 60 configured for alignment with the inlet track section 14 and exit track section 20 to form a continuous pathway for travel of the toy vehicle combination 12 through the housing 10. The track portion 60 has an elongate slot 62 extending in the direction of travel of the toy vehicle combination 12, the slot 62 being generally centrally located relative to the opposite sidewalls 22 and 24 of the housing 10. Beneath the track portion 60, the housing 10 includes a generally rectangular compartment 63 for receiving the booster mechanism therein. The booster mechanism includes a generally box-like sled member 64 which is open at the top thereof and has pivotally mounted therein a rocker arm member generally designated 66 having a first arm 68 and a second arm 70 with the arms 68 and 70 extending in opposite directions from the pivot point 72 with the arms 68 and 70 displaced at a slight upwardly extending angle relative to each other. The free end of arm 68 is provided with a cam edge 74 while the free end of arm 70 is provided with a vehicle engaging projection 76, the arm 70 being disposed in a direction toward the entrance end 16 of the housing 10, and the arm 68 being disposed toward the exit end 18 of the housing 10. The rocker arm member 66 may be formed by stamping from sheet metal or the like or may be molded of a convenient plastic material with the pivoting thereof being within the sled member 64 by means of a pivot pin 72 extending along a line generally parallel to the plane of the track portion 60. Secured to the sled member 64 along a line parallel to the pivot axis 32 is the reset lever 32 which projects outwardly through the slot 30 in the sidewall 24 of the housing 10. The rocker arm member 66 is configured to have the arm 70 thereof longer than the arm 68 and consequently the natural tendency of the rocker arm member 66 will be to rotate toward the position illustrated in FIG. 3, that is, to pivot counterclockwise about its pivot axis 72. Alternatively, the length of slot 62 may be such that rearward movement of sled member 64 causes the end of arm 70 to engage the tapered edge of slot 62 to thereby pivot rocker arm member 66 to the cocking position.

Also contained within the compartment 63 as part of the booster mechanism is a tension spring 80 having one end thereof secured to an endwall 82 of compartment 63, and the other end thereof secured to a suitable projection or tang 84 of the sled member 64, the spring 80 biasing the sled member 64 to the right as viewed in FIGS. 3–5.

To "set" the booster mechanism, the lever 32 is grasped and pulled to the left until the cam portion 74 of the rocker arm member 66 passes the edge of slot 62 adjacent thereto, thereby permitting the rocker arm member 66 to rotate in a counterclockwise direction due to engagement with the edge of slot 62 or under the force of the weight of arm 70 thereof. The reset lever 32 is then released a slight distance with sled member 64 traversing to the right until the cam edge 74 protrudes through the slot 62 for abuttingly engaging the adjacent edge of the slot 62 with a portion of cam portion 74 extending above the plane of the surface of track 60 for subsequent impact with the toy vehicle 34.

On the interior of housing 10, the sidewalls are provided with inwardly extending generally identically configured ramp portions 88 (only one of which is shown) which are angularly directed upwardly from the entrance end 16 of the housing 10, the ramp portions 88 coacting with a generally horizontal segment 90 which terminates in a slightly downwardly extending portion 92. Positioned above the downwardly extending portion 92 is an abutment member 94 with a suitable shock absorbing means such as a foam pad 96 interposed between the abutment 94 and the portion 92, the spacing between the two parts being sufficient for receiving the protuberances 54 and 56 of the shell member 40 as will hereinafter be described. Spaced downwardly from the generally horizontal segment 90 is an inwardly extending projection 98 having a ramp edge 100 configured for guiding the lower edge of the shell member 40 during operation of the toy.

As shown in FIG. 4, the toy vehicle combination 12 enters the entrance end 16 under its own inertia to traverse the track portion 60. During the initial portion of this traversal, the protuberances 54 and 56 of the shell member 40 will engage the ramp portions 88 which are spaced from each other generally parallel and a distance sufficient for guiding the protuberances 54 and 56 thereon. The shell member 40 will then begin to separate from the toy vehicle 34 and then travel under its own inertia until the protuberances 54 and 56 traverse the horizontal segment 90 to fit within the recess between the downwardly inclined segment 92 and the abutment projection 94 until the protuberances 54 and 56 are abutting against the foam pads 96. At this point, the lower edges of the shell member 40 will be resting on the projection 98 for retention within the housing 10.

As the toy vehicle 34 commences separation relative to the shell member 40, the front end of the vehicle 34 contacts the cam portion 74 of the rocker arm member 66, thereby driving arm 58 downwardly as indicated by the arrow adjacent thereto in FIG. 4 to thereby rock or pivot the arm 70 upwardly. The overall size of the rocker arm 66 is sufficient to enable the vehicle engaging projection 76 to engage the rear bumper or end of the toy vehicle 34. With the arm 68 depressed downwardly, the contoured surface of the cam portion 74 thereof in coaction with the force of the spring 80 draws the sled 64 to the right to thereby propel the toy vehicle 34 outwardly through the exit end 18 at a greater speed than that at which it entered. As shown in FIG. 5, the shell member 40 is suitably retained within the upper portion of the interior of housing 10 as the vehicle 34 is propelled through the exit end 18 of housing 10. The overall illusion thus created is that of a slow moving bulky vehicle entering a housing 10 at a relatively slow rate of speed with a sportier or racy type vehicle exiting the housing at a greater rate of speed as a consequence of the booster mechanism. It is to be understood, however, that the toy vehicle combination 12 may include a self-propelled toy vehicle 34 and the booster mechanism will not be required in such event although the illusion will still be maintained. For subsequent removal of the shell member 40 for replacement on the toy vehicle 34, either or both of the cover members 26 and 28 may be pivoted or removed to provide access to the interior of the housing 10 for retrieving the shell member 40.

While there has been shown and described a preferred embodiment, it is to be understood that various other adaptations and modifications may be made within the spirit and scope of the invention.

What is claimed is:

1. In a toy vehicle and accessory set, the combination comprising:

a toy vehicle having a body;

a shell member configured for simulating a body of another type vehicle;

means on said shell member configured for engaging portions of said toy vehicle body, said shell member having a size sufficient for concealing said toy vehicle body when so engaged;

a housing having sidewalls and a track portion adjacent the bottom thereof, said housing having an entrance end and an exit end for passage of said toy vehicle therethrough; and coacting means on said shell member and said housing for removing said shell member from said vehicle during traversal of said vehicle on said track portion from the entrance to the exit end of said housing; and means within said housing for retaining said so-removed shell member therein.

2. The combination according to claim 1 wherein said coacting means includes inwardly extending ramp portions on opposing sidewalls of said housing and outwardly extending protuberances on said shell member for engaging said ramp portions during traversal of said toy vehicle and for elevating said shell member under the force of inertia.

3. The combination according to claim 2 wherein the body of said toy vehicle includes fender members and said shell member includes inwardly extending projections on the interior surface thereof configured for coacting with said fender members for retaining said shell member on said toy vehicle.

4. The combination according to claim 1 wherein said housing further includes a booster mechanism responsive to impact of said toy vehicle for accelerating said toy vehicle from the exit end of said housing.

5. The combination according to claim 4 wherein said booster mechanism is mounted within said housing below said track portion.

6. The combination according to claim 5 wherein said booster mechanism includes a sled member slidably mounted within a compartment beneath said track portion and a spring member for urging said sled member toward the exit end of said housing.

7. The combination according to claim 6 wherein said booster mechanism includes a rocker arm member pivotally mounted within said sled member, said track portion includes an elongate slot, and said rocker arm member has a first arm configured for engaging the end of said slot adjacent said exit end for retaining said sled member with a portion of said first arm extending through said slot for engagement by said vehicle.

8. The combination according to claim 7 wherein said rocker arm member includes a second arm configured for passing through said slot upon pivoting of said arm rocker arm member, said second arm having a vehicle engaging member, impact by said vehicle releasing said first arm from engagement with said slot, said vehicle engaging member propelling said toy vehicle toward said exit end after separation of said shell member from said toy vehicle.

9. The combination according to claim 8 wherein said second arm is longer than said first arm for urging said rocker arm member to pivot toward said second arm under the force of the weight of said second arm.

10. The combination according to claim 8 wherein said rocker arm member and said slot are so dimensioned that during movement of said sled member toward the entrance end of each housing, said second arm engages the end of said slot for pivoting said rocker arm member.

11. The combination according to claim 2 wherein said means for retaining said shell member within said housing includes inwardly extending projections on opposing sidewalls of said housing for engaging the lower opposite edges of said shell member.

12. The combination according to claim 11 wherein said means for retaining said shell member include shock absorbing means configured for coacting with at least one of said shell members and said protuberances.

13. The combination according to claim 12 wherein said booster mechanism further includes a reset lever member secured to said sled member, said lever member extending through a sidewall of said housing.

14. The combination according to claim 13 wherein the sidewall of said housing has an elongate slot for passage therein of said lever member.

* * * * *